US011791533B2

(12) United States Patent
Bertel et al.

(10) Patent No.: US 11,791,533 B2
(45) Date of Patent: Oct. 17, 2023

(54) ANTENNA PANE

(71) Applicant: SAINT-GOBAIN GLASS FRANCE, Courbevoie (FR)

(72) Inventors: David Bertel, Aachen (DE); Guillaume Francois, Aachen (DE); Stefan Droste, Herzogenrath (DE)

(73) Assignee: SAINT-GOBAIN GLASS FRANCE, Courbevoie (FR)

( * ) Notice: Subject to any disclaimer, the term of this patent is extended or adjusted under 35 U.S.C. 154(b) by 212 days.

(21) Appl. No.: 17/599,291

(22) PCT Filed: Mar. 29, 2020

(86) PCT No.: PCT/EP2020/058882
§ 371 (c)(1),
(2) Date: Sep. 28, 2021

(87) PCT Pub. No.: WO2020/201170
PCT Pub. Date: Oct. 8, 2020

(65) Prior Publication Data

US 2022/0173493 A1 Jun. 2, 2022

(30) Foreign Application Priority Data

Mar. 29, 2019 (EP) ..... 19166110

(51) Int. Cl.
*H01Q 1/12* (2006.01)
*H01Q 9/30* (2006.01)
*H01Q 13/10* (2006.01)

(52) U.S. Cl.
CPC ..... *H01Q 1/1271* (2013.01); *H01Q 9/30* (2013.01); *H01Q 13/106* (2013.01)

(58) Field of Classification Search
CPC ..... H01Q 1/1271; H01Q 9/30; H01Q 13/106; H05B 3/84
See application file for complete search history.

(56) References Cited

U.S. PATENT DOCUMENTS 10,211,509 B2 * 2/2019 Kagaya ..... H01Q 1/325
2003/0080909 A1 5/2003 Voeltzel
(Continued)

FOREIGN PATENT DOCUMENTS

DE 198 17 712 C1 2/2000
DE 199 27 683 C1 1/2001
(Continued)

OTHER PUBLICATIONS

International Search Report as issued in International Patent Application No. PCT/EP2020/058882, dated Jul. 22, 2020.
(Continued)

*Primary Examiner* — Awat M Salih
(74) *Attorney, Agent, or Firm* — Pillsbury Winthrop Shaw Pittman LLP

(57) ABSTRACT

An antenna pane includes an electrically insulating substrate, an electrically conductive functional layer on a surface of the substrate, and an antenna structure, which includes an electrically conductive antenna layer for receiving and/or transmitting high-frequency antenna signals, the antenna layer being galvanically separated from the functional layer, wherein a high-frequency technical resistance between the antenna layer and the functional layer for high-frequency antenna signals is at least 10 ohm, wherein the antenna layer has a first connection region and the functional layer has a second connection region, and an insulating line that electrically divides the functional layer into a first and second functional layer zone that are galvanically separated from one another, but are coupled using high-frequency technology such that a high-frequency technical resistance for high-frequency antenna signals is less than 1 ohm, wherein the second connection region is contained in the second functional layer zone.

21 Claims, 4 Drawing Sheets

(56) References Cited

U.S. PATENT DOCUMENTS

Figure 1:
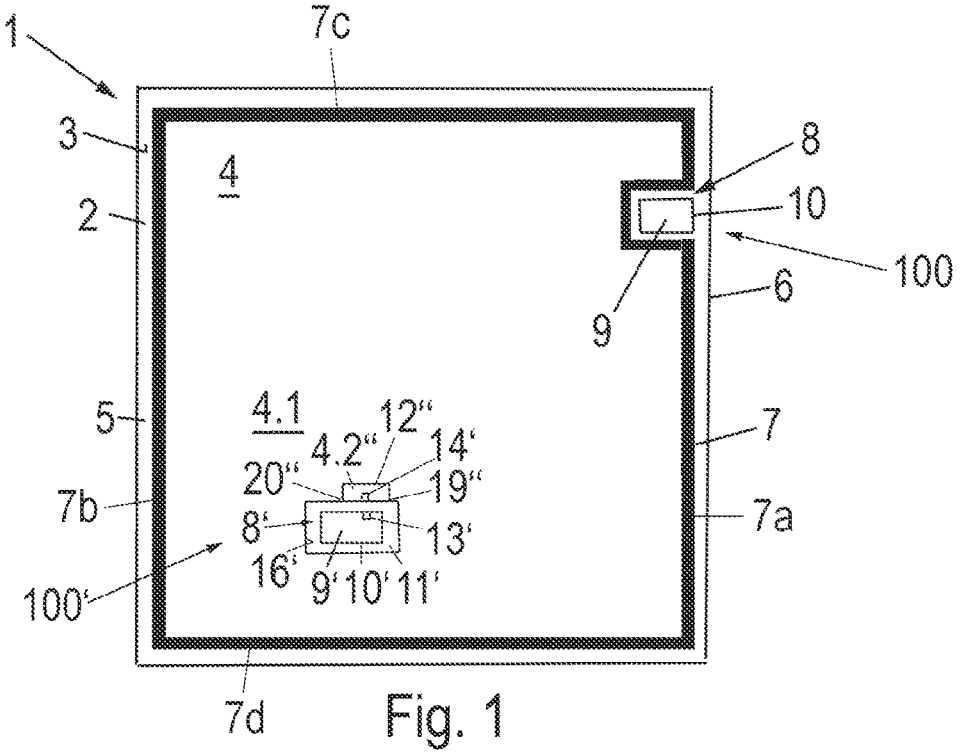

| | | | | |
|---|---|---|---|---|
| 2003/0112190 | A1 | 6/2003 | Baliarda et al. | |
| 2006/0152421 | A1 | 7/2006 | Baranski | |
| 2006/0202897 | A1 | 9/2006 | Roquiny | |
| 2014/0176374 | A1 | 6/2014 | Lo | |
| 2017/0251525 | A1* | 8/2017 | Chamberlain | H05B 3/84 |
| 2017/0346154 | A1* | 11/2017 | Kagaya | H01Q 13/106 |
| 2018/0037006 | A1 | 2/2018 | Droste et al. | |

FOREIGN PATENT DOCUMENTS

| | | | | |
|---|---|---|---|---|
| DE | 101 06 125 | A1 | 8/2002 | |
| DE | 103 14 094 | A1 | 3/2004 | |
| DE | 10314094 | A1 * | 3/2004 | B32B 17/10036 |
| DE | 103 19 606 | A1 | 11/2004 | |
| DE | 10 2009 006 062 | A1 | 7/2010 | |
| EP | 0 378 917 | A1 | 7/1990 | |
| EP | 0 717 459 | A1 | 6/1996 | |
| EP | 0 720 249 | A2 | 7/1996 | |
| EP | 0 847 965 | B1 | 10/2004 | |
| EP | 1 605 729 | A2 | 12/2005 | |
| EP | 0 912 455 | B1 | 5/2006 | |
| EP | 1 218 307 | B1 | 7/2008 | |
| EP | 1 917 222 | B1 | 3/2009 | |
| EP | 1 266 424 | B1 | 6/2009 | |
| EP | 2 960 986 | B1 | 8/2017 | |
| EP | 3 249 743 | A1 | 11/2017 | |
| EP | 3 300 167 | A1 | 3/2018 | |
| EP | 3 192 326 | A1 | 5/2018 | |
| JP | 2018-513638 | A | 5/2018 | |
| WO | WO 2007/101964 | A1 | 9/2007 | |
| WO | WO 2010/043598 | A1 | 4/2010 | |
| WO | WO 2014/060203 | A1 | 4/2014 | |
| WO | WO 2016/185898 | A1 | 11/2016 | |

OTHER PUBLICATIONS

Notice of Reasons for Refusal as issued in Japanese Patent Application No. 2021-557800, dated Dec. 6, 2022.

* cited by examiner

ANTENNA PANE

CROSS-REFERENCE TO RELATED APPLICATIONS

This application is the U.S. National Stage of PCT/EP2020/058882, filed Mar. 29, 2020, which in turn claims priority to European patent application number 19 166 110.7 filed Mar. 29, 2019. The content of these applications are incorporated herein by reference in their entireties.

The invention is in the technical field of pane production and relates to an antenna pane with one or a plurality of integrated patch antennas, an antenna pane assembly, a method for producing the antenna pane, and use thereof.

Modern motor vehicles have a large number of technical devices for transmitting and receiving high-frequency electromagnetic radiation, in particular to enable the operation of basic services such as radio reception, mobile telephony, satellite-based navigation (GPS), and wireless Internet (WLAN). In mobile telephony, the introduction of the 5G standard is planned, with which, compared to the previous 4G standard, many times higher data rates and capacities can be achieved. 5G is expected to use the frequency range of 0.6 to 6 GHz. This poses new challenges for vehicle manufacturers, as 5G also envisages the use of so-called MIMO (multiple input multiple output) technology, in which multiple transmitting and receiving antennas are used for data transmission.

Vehicle glazings of current vehicles increasingly have full-surface, electrically conductive layers that are transparent to visible light. These electrically conductive layers are used, for example, for protection of the vehicle interior against overheating due to sunlight, by reflecting incident thermal radiation, as is known, for example, from EP 378917 A. On the other hand, electrically conductive layers can effect targeted heating of the pane through application of an electrical voltage in order to remove ice or condensation, as is known, for example, from WO 2010/043598 A1.

Electrically conductive layers are impermeable to electromagnetic radiation in the high-frequency range. When the glazing of the vehicle is equipped on all sides and over the entire surface with electrically conductive layers, the transmitting and receiving of electromagnetic radiation in the interior of the motor vehicle is no longer possible. Usually, localized regions of the electrically conductive layer are decoated for the operation of sensors arranged in the vehicle interior, such as rain sensors, camera systems, or stationary antennas. These decoated regions, which form so-called "communication" or "data transmission windows", are known, for example, from EP 1605729 A2.

Since the coloring and reflective action of a pane are influenced by transparent, electrically conductive layers, layer-free communication windows are very conspicuous visually. In addition, visual interference can result from the decoated regions such that positioning in the driver's field of vision must be avoided so as not to impair driving safety. For this reason, communication windows are arranged in inconspicuous positions of the pane, for example, in the region of the inside mirror of a windshield, and covered by masking prints and plastic screens.

The formation of a grid in the region of the communication window is also known. Panes with a metallic layer that have gridlike decoating of the metallic layer, which acts as a low-pass filter for incident high-frequency electromagnetic radiation, are known from EP 0 717 459 A1, US 2003/0080909 A1, and DE 198 17 712 C1. A pane with a metallic layer whose gridlike decoating is transparent to high-frequency electromagnetic radiation is known from WO 2014060203 A1.

Depending on the application, such communication windows can be too small to allow the transmitting and receiving of high-frequency electromagnetic radiation, as is necessary, for example, for mobile telephony and satellite-based navigation. This is especially true when the antenna required for this purpose is arranged far from the pane and only little signal intensity can reach the reception region of the antenna or only little signal intensity can be transmitted through the communication window to the outside. Nevertheless, the user expects that mobile phones can be operated at any position in the interior of a vehicle.

The use of body-mounted external antennas for high-frequency electromagnetic radiation is known, for example, from US 20140176374 A1. However, such antennas adversely affect the aesthetic appearance of the vehicle, can cause wind noise, and are sensitive to damage and vandalism. To avoid external antennas, it is known, for example, from DE 10106125 A1, DE 10319606 A1, EP 0720249 A2, US 2003/0112190 A1, and DE 19843338 C2 to use the transparent, electrically conductive layer itself as a patch antenna. For this purpose, the electrically conductive layer is galvanically or capacitively coupled with a coupling electrode and the antenna signal is made available in the edge region of the pane. The antenna signal coupled out from the patch antenna is routed to an antenna amplifier that is connected to the metal body in motor vehicles, thus providing the antenna signal a reference potential that is effective in high-frequency technology. The usable antenna voltage results from the difference between the reference potential of the vehicle body and the potential of the antenna signal.

EP 3 300 167 A1 discloses a pane with a monopole antenna of the unipolar type. The wire-shaped monopole antenna has a first connection region that serves as a first electrode. An electrically conductive coating of the pane has a second connection region that serves as a second electrode.

EP 3 249 743 A1 discloses a pane with an electrically conductive coating, in which a slot antenna is incorporated. A region of the coating provides a reference potential.

In contrast, the object of the present invention consists in providing an improved pane (hereinafter referred to as "antenna pane" for ease of reference) with one or a plurality of integrated patch antennas that enables good reception of high-frequency electromagnetic radiation, in particular in the frequency range of mobile telephony in accordance with the 5G standard, and is simple and economical to produce.

These and other objects are accomplished according to the proposal of the invention by an antenna pane in accordance with the independent claim. Advantageous embodiments of the invention result from the dependent claims.

According to the invention, an antenna pane is shown that preferably serves to separate an interior from an external environment. Preferably, the antenna pane is a vehicle pane of a motor vehicle, for example, a windshield (vehicle antenna pane).

The antenna pane comprises at least one electrically insulating substrate as well as at least one electrically conductive, preferably transparent, layer on the substrate, hereinafter referred to as "functional layer" for easier reference. The functional layer is, for example, applied directly on the substrate. However, it is also possible for one or a plurality of additional layers made of materials different from the substrate and the functional layer to be situated between the surface of the substrate and the functional layer. The functional layer is typically fully bordered by a layer-free edge decoating zone of the antenna pane, wherein the edge decoating zone is immediately adjacent the functional layer.

The antenna pane includes at least one antenna structure, in particular a plurality of antenna structures. A description of the antenna structure follows.

The or each antenna structure comprises an electrically conductive layer with antenna function, hereinafter referred to as "antenna layer" for easier reference, which serves for receiving and/or transmitting high-frequency antenna signals. In the context of the present invention, high-frequency antenna signals are to be in the frequency range from 600 MHz to 6 GHz, i.e., In the frequency range intended for the 5G mobile communication standard. The antenna layer is preferably transparent to visible light. In accordance with the common understanding of the term "layer", the antenna layer is an a really-extended structure, wherein a minimum dimension in the area exceeds the layer thickness many times over, e.g., by a factor of 100 or 1000. In particular, the antenna layer serves as a patch antenna and does not have a linear shape, i.e., the antenna layer is in particular not a wire antenna or a slot antenna.

The at least one antenna layer is galvanically separated from the functional layer, wherein a high-frequency technical resistance between the antenna layer and the functional layer for high-frequency antenna signals received and/or transmitted by the antenna layer is at least 10 ohm, preferably at least 30 ohm, more preferably at least 50 ohm. The high-frequency technical resistance is the electrical resistance between the antenna layer and the functional layer for antenna signals received and/or transmitted by the antenna layer. Thus, the electrical resistance between the antenna layer and functional layer for high-frequency antenna signals is high ohmic and the antenna layer is strongly decoupled from the functional layer in terms of high-frequency technology.

The antenna layer of the at least one antenna structure has a first connection region or signal-line connection region, which serves as a first (coupling) electrode for coupling out and/or coupling in of high-frequency antenna signals received and/or transmitted by the antenna layer. The functional layer has at least one second connection region or ground-line connection region, which serves as a second (coupling) electrode for providing a reference potential for the antenna signals.

For electrical connection to receiving and/or transmitting electronics, the first connection region can be or is coupled, e.g., galvanically or capacitively, to a signal line. In addition, the second connection region can be or is electrically coupled, e.g., galvanically or capacitively, to a ground line.

The functional layer, which is galvanically separated from the antenna layer and has high-ohmic electrical resistance to the antenna layer for high-frequency antenna signals, provides an effective reference potential in terms of high-frequency technology for the antenna signals. The usable antenna voltage results from the difference between the reference potential of the functional layer and the potential of the antenna signals.

The functional layer can thus advantageously function as an electrical ground if it is galvanically separated from the antenna layer and decoupled in terms of high-frequency technology. In this way, a reference potential for the antenna signals received by the antenna layer can be provided simply and independently of the environment of the antenna pane. It is, for example, unnecessary to provide a reference potential through the metallic vehicle car body, as a result of which the installation of the antenna pane is simplified and the function of the integrated patch antenna can even be realized independently of the vehicle. In the case of use in buildings, providing a reference potential can sometimes only be realized with relatively great effort, which can advantageously be avoided in accordance with the invention. The antenna pane according to the invention thus advantageously enables integration of both the antenna layer functioning as a patch antenna and the electrical ground providing the reference potential into the antenna pane. In particular, the passage of high-frequency electromagnetic radiation through a communication window can be avoided. In addition, multiple antenna layers, each serving as a patch antenna, can be implemented in a simple manner in one and the same antenna pane. In particular, this enables reception and/or transmission of mobile communication signals in accordance with the new 5G standard. The antenna layer serving as a patch antenna of the antenna pane according to the invention can equally serve to transmit antenna signals. The patch antenna of the antenna pane is preferably implemented in the form of a monopole antenna. In this case, the antenna layer and the functional layer are implemented in a corresponding manner as a monopole antenna.

The antenna structure of the or of each antenna structure further includes an insulating line, by means of which the functional layer is electrically divided into two functional layer zones that are galvanically separated from one another, but are coupled using high-frequency technology such that a high-frequency technical resistance for high-frequency antenna signals is less than 1 ohm. Here, it is essential that (only) one of the two functional layer zones contains the second connection region (ground-line connection region). For simpler reference, the function layer zone containing the second connection region is referred to as "the second functional layer zone"; the other functional layer zone, as "the first functional layer zone".

To achieve a high-frequency technical resistance for high-frequency antenna signals of less than 1 ohm, the insulating line advantageously has a width of less than 150 μm. The two functional layer zones are then low ohmically connected to one another in terms of high-frequency technology. Thus, as a result of the insulating line, a functional layer zone containing the ground-line connection region is created (i.e., second functional layer zone), which is galvanically separated from the remaining functional layer (i.e., first functional layer zone) such that a current conducted in the functional layer (e.g., heating current of the functional layer) cannot be introduced into the functional layer zone containing the ground-line connection region. At the same time, high-frequency antenna signals can pass through the insulating line.

In accordance with one embodiment of the antenna pane according to the invention, the antenna layer of the at least one antenna structure is arranged, at least when viewed perpendicularly through the at least one substrate, at least partially, in particular completely, within a cutout of the functional zone.

In the immediately preceding embodiment of the antenna pane according to the invention, it is advantageous for the antenna layer and the functional layer of the at least one antenna structure to be arranged on the same surface of the at least one substrate. The antenna layer of the at least one antenna structure is then situated at least partially, in particular completely, within a cutout of the functional zone, i.e., not only when viewed perpendicularly through the at least one substrate, but also with respect to the layer plane of the functional layer. In this case, the at least one antenna layer is galvanically separated by an electrically insulating region (hereinafter referred to as "insulation zone"), which is, for this purpose, partially or completely free of electrically conductive material, in particular material of the functional layer. The spatial distance between the antenna layer and the functional layer caused by the insulation zone is selected such that a resistance of at least 10 ohm, preferably at least 50 ohm, is provided for the high-frequency antenna signals received and/or transmitted by the antenna layer. Preferably, for this purpose, a minimum distance of the antenna layer from the functional layer is at least 0.5 mm and is, in particular, in the range from 0.5 mm to 5 mm. The insulation zone can, in particular, be produced by removing the functional layer. The antenna layer, the functional layer, and the insulation zone are arranged directly adjacent one another. Preferably, the cutout is produced by complete removal of the functional layer.

In accordance with an alternative embodiment, the antenna layer and the functional layer of the at least one antenna structure are arranged on different surfaces of the at least one substrate, in particular on different surfaces of a plurality of substrates. In this case, in the installed state of the antenna pane, the antenna layer is preferably arranged closer to the interior than the functional layer. Here, it is essential for the at least one antenna layer, when viewed perpendicularly through the substrate (i.e., when orthogonally projected onto the substrate), to be situated at least partially within a cutout formed in the functional layer, which cutout is partially or completely free of the functional layer such that the cutout is transparent to high-frequency electromagnetic radiation, which can be received and/or transmitted by the antenna layer. Thus, in this embodiment, the cutout does not have to be completely free of the conductive layer, but it is only necessary to ensure transmission of the high-frequency electromagnetic radiation. For this purpose, the cutout or pass-through region is either completely decoated or provided with a grid made of the material of the functional layer that is transparent to high-frequency electromagnetic radiation that can be received by the antenna layer. Such a grid emerges from VO 2014060203A1 mentioned in the introduction, the disclosure of which is referenced in its entirety, in particular as relates to the design of the grid transparent to high-frequency electromagnetic radiation. The pass-through region is up to at least 70%, preferably up to at least 80%, more preferably up to at least 90% transparent to high-frequency electromagnetic radiation.

In accordance with one embodiment of the antenna pane according to the invention, in which the antenna layer is arranged, at least when viewed perpendicularly through the at least one substrate, within a cutout of the functional zone, the at least one antenna structure includes an insulating line that completely surrounds a cutout edge (formed by the functional layer) delimiting the cutout. In this case, the second functional layer zone containing the second connection region completely surrounds the cutout. This applies both to the case in which the cutout is arranged at the very edge of the functional layer and to the case in which the cutout is arranged completely within the functional layer. It goes without saying that a cutout at the very edge is defined only by the cutout edge formed by the functional layer such that the second functional layer zone can surround only the cutout edge, but not the "open" edge of the cutout, on which no material of the functional layer is situated.

In the immediately preceding embodiment of the antenna pane according to the invention, it is advantageous for the insulating line that extends from a first insulating line end point to a second insulating line end point to be implemented such that the at least one insulating line end point, in particular both insulating line end points, lie on a functional edge of the functional layer not forming part of the cutout.

In accordance with an alternative embodiment of the antenna pane according to the invention, in which the antenna layer, at least when viewed perpendicularly through the at least one substrate, is arranged within a cutout of the functional zone, the at least one antenna structure includes an insulating line that does not completely surround a cutout edge (formed by the functional layer) delimiting the cutout. In this case, the second functional layer zone containing the second connection region does not completely surround the cutout. This applies both to the case in which the cutout is arranged at the very edge of the functional layer and to the case in which the cutout is arranged completely within the functional layer.

In the immediately preceding embodiment of the antenna pane according to the invention, it is advantageous for the insulating line that extends from a first insulating line end point to a second insulating line end point to be implemented such that at least one insulating line end point, in particular both insulating line end points, lie on the cutout edge.

A cutout of the functional layer is, for example, arranged completely inside the functional layer. In this case, the antenna layer is surrounded on its entire periphery by the functional layer, with the insulation zone situated between the antenna layer and the functional layer when the antenna layer and the functional layer are situated on the same surface of the at least one substrate.

Alternatively, a cutout of the functional layer is arranged at the very edge of the functional layer and is formed by a depression or indentation of the edge of the functional layer. In this case, the antenna layer is surrounded on only part of the periphery by the functional layer, with only a section of the antenna layer adjacent the pane edge not surrounded by the functional layer ("open edge of the cutout"). In this case as well, the insulation zone is situated between the antenna layer and the functional layer, when the antenna layer and the functional layer are arranged on the same surface of the at least one substrate, with the antenna layer, the functional layer, and the insulation zone arranged immediately adjacent one another. The cutout is delimited by a cutout edge that is formed by the functional layer. The edge of the antenna layer arranged at the pane edge is preferably arranged aligned with an edge of the functional layer (but separated therefrom by the insulation zone). Preferably, the edge of the antenna layer adjacent the pane edge is directly adjacent the layer-free edge decoating zone of the antenna pane.

When the antenna layer is arranged within a layer-free cutout of the functional layer and the antenna layer is formed from the material of the functional layer, the term "cutout" of the functional layer is understood to mean that the antenna layer is not part of the functional layer.

In accordance with an embodiment of the antenna pane according to the invention, the antenna layer of the or of each antenna structure is advantageously made of the same material as the functional layer and is formed from the functional layer, wherein the insulation zone situated between functional layer and the antenna layer is produced by partial or complete removal of the functional layer. As a result of this measure, the antenna layer can be produced from the functional layer itself in a simple and economical manner.

However, it is also possible for the antenna layer to be made of a material different from the functional layer and implemented, for example, in the form of a metal foil applied on the substrate, for example, a copper, silver, gold, or aluminum foil. The electrically conductive foil advantageously has a thickness of from 50 μm to 1000 μm and preferably of from 100 μm to 600 μm. The electrically conductive foil advantageously has conductivity of from $1*10^6$ S/m to $10*10^7$ S/m and preferably of from $3.5*10^7$ S/m to $6.5*10^7$ S/m. It is also conceivable to use a carrier film or carrier pane coated with a metal, for example, copper, silver, gold, or aluminum. The carrier film or carrier pane preferably contains or is made of a polymer, in particular polyvinyl butyral (PVB), ethylene vinyl acetate (EVA), polyurethane (PU), polyethylene terephthalate (PET), or combinations thereof. Such films are preferably bonded to the substrate, for example, using a thin adhesive film or a double-sided adhesive tape.

Alternatively, the antenna layer is made of a printed and baked electrically conductive paste, preferably a silver-containing screen-printing paste. An advantageous printed antenna layer has a thickness of 3 μm to 20 μm and/or sheet resistance of 0.001 ohm/square to 0.03 ohm/square, preferably of 0.002 ohm/square to 0.018 ohm/square. Such antenna layers are easy to integrate in the industrial manufacturing process and are economical to produce.

Each antenna structure comprises an antenna layer, a first connection region, and a second connection region, as well as an insulating line. When the antenna layer is arranged at least partially, in particular completely, within a cutout and when the antenna layer and the functional layer are arranged on the same surface of the substrate, the antenna structure also includes an insulation zone.

The functional layer is arranged on a surface of the substrate and covers the surface of the substrate partially, but preferably over a large area. The expression "over a large area" means that at least 50%, at least 60%, at least 70%, at least 75%, or preferably at least 90% of the surface of the substrate is covered (e.g., coated) by the functional layer. In particular, the functional layer can even extend over the entire surface of the substrate, with the exception of one or a plurality of layer-free regions that galvanically separate the antenna layer(s) from the functional layer or form a pass-through region. The functional layer can, however, also extend over smaller portions of the surface of the substrate, for example, smaller than 50%, smaller than 30%, or smaller than 20%, which can be desirable, for example, when only a small region of the antenna pane is to be electrically heated by the functional layer. According to the invention, large-area coverage of the substrate with the functional layer is preferred.

The at least one substrate preferably contains or is made of glass, particularly preferably flat glass, float glass, quartz glass, borosilicate glass, soda lime glass, or clear plastics, preferably rigid clear plastics, in particular polyethylene, polypropylene, polycarbonate, polymethyl methacrylate, polystyrene, polyamide, polyester, polyvinyl chloride, and/or mixtures thereof. Suitable glasses are, for example, known from EP 0 847 965 B1.

The thickness of the at least one substrate can vary widely and be adapted to the requirements of the individual case. Preferably, substrates having the standard thicknesses of from 1.0 mm to 25 mm and preferably from 1.4 mm to 2.1 mm are used. The size of the substrate can vary widely and is governed by the use.

The substrate can have any three-dimensional shape. Preferably, the three-dimensional shape has no shadow zones such that it can, for example, be coated by cathodic sputtering. Preferably, the substrate is planar or slightly or greatly curved in one or a plurality of spatial directions. The substrate can be colorless or colored.

The antenna pane is, for example, implemented in the form of a single pane or a composite pane. The composite pane usually comprises two preferably transparent substrates that correspond to an inner pane and an outer pane that are fixedly bonded to one another by at least one thermoplastic adhesive layer, wherein the at least one functional layer is situated on at least one surface of at least one of the two substrates of the composite pane. Preferably, the at least one functional layer is situated on an inner surface of the composite pane in order to protect it from external influences.

The thermoplastic intermediate layer contains or is made of at least one thermoplastic plastic, preferably polyvinyl butyral (PVB), ethylene vinyl acetate (EVA), and/or polyethylene terephthalate (PET). The thermoplastic intermediate layer can, however, also contain, for example, polyurethane (PU), polypropylene (PP), polyacrylate, polyethylene (PE), polycarbonate (PC), polymethyl methacrylate, polyvinyl chloride, polyacetate resin, casting resin, acrylate, fluorinated ethylene-propylene, polyvinyl fluoride, and/or ethylene-tetrafluoroethylene, or a copolymer or mixture thereof. The thermoplastic intermediate layer can be formed by one or a plurality of thermoplastic films arranged one above another, wherein the thickness of one thermoplastic film is preferably from 0.25 mm to 1 mm, typically 0.38 mm or 0.76 mm.

The antenna pane has, for example, a circumferential edge region with a width of 2 mm to 50 mm, preferably of 5 mm to 20 mm that is not provided with the functional layer. The functional layer advantageously has no contact with the atmosphere and is, for example, protected by the thermoplastic intermediate layer, in the interior of a composite pane, against damage and corrosion.

The functional layer is preferably transparent to visible light. Preferably, the substrate and the antenna pane are also transparent to visible light. In the context of the present invention, "transparent" means that the total transmittance of the antenna pane complies with the legal requirements for windshields and front side windows and preferably has transmittance for visible light of more than 70% and in particular of more than 75%. For rear side windows and rear windows "transparent" can also mean 10% to 70% light transmittance. In an advantageous embodiment, the functional layer is a single layer or a layer structure comprising a plurality of single layers with a total thickness less than or equal to 2 μm, particularly preferably less than or equal to 1 μm. Preferably, the antenna pane has transparency for visible light of more than 85%.

The functional layer can, in principle, be any electrically conductive layer that fulfills a specific pre-definable function for the antenna pane.

For example, the functional layer is a layer with a solar protection effect. Such a layer with a solar protection effect has reflective properties in the infrared range and thus in the range of solar radiation, by means of which heating up of the interior of the building or a motor vehicle due to solar radiation is advantageously reduced. Layers with a solar protection effect are well-known to the person skilled in the art and typically contain at least one metal, in particular silver or a silver-containing alloy. The layer with a solar protection effect can include a sequence of multiple individual layers, in particular at least one metallic layer and dielectric layers that contain, for example, at least one metal oxide. The metal oxide preferably contains zinc oxide, tin oxide, indium oxide, titanium oxide, silicon oxide, aluminum oxide, or the like, and combinations of one or a plurality thereof. The dielectric material contains, for example, silicon nitride, silicon carbide, or aluminum nitride. Layers with a solar protection effect are known, for example, from DE 10 2009 006 062 A1, WO 2007/101964 A1, EP 0 912 455 B1, DE 199 27 683 C1, EP 1 218 3071B1, and EP 1 917 222 B1.

The thickness of a layer with a solar protection effect can vary widely and be adapted to the requirements of the individual case, with a layer thickness of 10 nm to 5 μm and in particular of 30 nm to 1 μm being preferred. The sheet resistance of a layer with a solar protection effect is preferably from 0.35 ohms/square to 200 ohm/square, preferably 0.5 ohm/square to 200 ohm/square, most particularly preferably from 0.6 ohm/square to 30 ohm/square, and in particular from 2 ohm/square to 20 ohm/square. The layer with a solar protection effect has, for example, good infrared reflecting properties and/or particularly low emissivity (low-E).

The functional layer can, for example, also be an electrically heatable layer, by means of which the antenna pane is provided with a heating function. Such heatable layers are known per se to the person skilled in the art. They typically contain one or a plurality of, for example, two, three, or four, electrically conductive layers. These layers preferably contain or are made of at least one metal, for example, silver, gold, copper, nickel, and/or chromium, or a metal alloy and preferably contain at least 90 wt.-% of the metal, in particular at least 99.9 wt.-% of the metal. Such layers have particularly advantageous electrical conductivity with simultaneously high transmittance in the visible spectral range. The thickness of a single layer is preferably from 5 nm to 50 nm, particularly preferably from 8 nm to 25 nm. With such a thickness, advantageously high transmittance in the visible spectral range and particularly advantageous electrical conductivity are achieved.

Typically, at least one dielectric layer is arranged in each case between two adjacent electrically conductive layers of the electrically heatable functional layer. Preferably, a further dielectric layer is arranged below the first and/or above the last electrically conductive layer. A dielectric layer contains at least one individual layer made of a dielectric material, for example, containing a nitride such as silicon nitride or an oxide such as aluminum oxide. Dielectric layers can, however, also include multiple single layers, for example, single layers of a dielectric material, smoothing layers, matching layers, blocking layers, and/or anti-reflection layers. The thickness of a dielectric layer is, for example, from 10 nm to 200 nm.

The electrically heatable functional layer is electrically connected to at least two bus bars through which a heating current can be fed into the functional layer. The bus bars are preferably arranged on the electrically conductive layer in the edge region of the electrically conductive layer along one side edge. The length of the bus bar is typically substantially equal to the length of the side edge of the electrically conductive layer, but can also be somewhat larger or smaller. Preferably, two bus bars are arranged on the electrically conductive layer, in the edge region along two opposite side edges of the electrically conductive layer. The width of the bus bar is preferably from 2 mm to 30 mm, particularly preferably from 4 mm to 20 mm. The bus bars are typically implemented in each case in the form of a strip, wherein the longer of its dimensions is referred to as the length and the less long of its dimensions is referred to as the width.

The bus bars are, for example, implemented as a printed and baked conductive structure. The printed bus bar contains at least one metal, preferably silver. The electrical conductivity is preferably realized via metal particles contained in the bus bar, particularly preferably via silver particles. The metal particles can be situated in an organic and/or inorganic matrix such as pastes or inks, preferably as a baked screen-printing paste with glass frits. The layer thickness of the printed bus bar is preferably from 5 μm to 40 μm, particularly preferably from 8 μm to 20 μm, and most particularly preferably from 10 μm to 15 μm. Printed bus bars with these thicknesses are technically easy to realize and have an advantageous current-carrying capacity. Alternatively, however, the bus bar can also be formed as a strip of an electrically conductive foil. The bus bar then contains, for example, at least aluminum, copper, tinned copper, gold, silver, zinc, tungsten, and/or tin or alloys thereof. The strip preferably has a thickness from 10 μm to 500 μm, particularly preferably from 30 μm to 300 μm. Bus bars made of electrically conductive foils with these thicknesses are technically easy to realize and have advantageous current-carrying capacity. The strip can be electrically conductively connected to the electrically conductive structure, for example, via a soldering compound, via an electrically conductive adhesive, or by direct application.

The electrically conductive layer can also be a surface electrode, for example, the surface electrode of a composite pane with electrically switchable or controllable optical properties. Such composite panes contain electrically switchable or controllable functional elements, for example, SPD (suspended particle device), PDLC (polymer dispersed liquid crystal), electrochromic, or electroluminescent functional elements and are known per se to the person skilled in the art. The surface electrodes contain at least one metal, a metal alloy, or a transparent conducting oxide (TCO), for example, silver, molybdenum, indium tin oxide (ITO), or aluminum-doped zinc oxide, and have layer thicknesses, for example, from 200 nm to 2 μm. The electrically conductive layer can also be a polymeric electrically conductive layer, for example, containing at least one conjugated polymer or a polymer provided with conductive particles.

The functional layer or a carrier film with the functional layer can be arranged on a surface of a single pane (substrate). In the case of a pane composite of two panes (substrates), a preferably transparent functional layer is situated on an inner surface of one and/or the other pane. In the case of a pane composite of more than two panes, multiple preferably transparent functional layers can be situated on multiple inner sides of the panes. Alternatively, the functional coating can be embedded between two thermoplastic intermediate layers. The functional layer is then preferably applied on a carrier film or carrier pane. The carrier film or carrier pane preferably contains a polymer, in particular polyvinyl butyral (PVB), ethylene vinyl acetate (EVA), polyurethane (PU), polyethylene terephthalate (PET), or combinations thereof.

When the antenna pane is implemented as a composite pane, it is preferable for the signal line and the ground line to be implemented in the form of a flat conductor. In this case, the flat conductor is preferably implemented as a strip conductor and in particular as a coplanar strip conductor whose signal line is electrically conductively coupled to the antenna layer and whose shielding (ground line) is electrically conductively coupled to the functional layer. Here, "electrically conductively coupled" preferably means galvanically connected. Alternatively, the signal line can be capacitively coupled to the antenna layer and the ground line can be capacitively coupled to the functional layer. The signal line and the ground line can also be implemented as separate flat conductors.

The strip conductor is preferably implemented as a foil conductor, in particular a flexible foil conductor (flat band conductor). "Foil conductor" means an electrical conductor whose width is significantly larger than its thickness. Such a foil conductor is, for example, a strip or tape containing or made of copper, tinned copper, aluminum, silver, gold, or alloys thereof. The foil conductor has, for example, a width of 2 mm to 16 mm and a thickness of 0.03 mm to 0.1 mm. The foil conductor can have an insulating, preferably polymeric sheathing, for example, based on polyimide. Foil conductors suitable according to the invention have a total thickness of, for example, only 0.3 mm. Such foil conductors can be arranged between the panes without difficulty. Multiple conductive layers electrically insulated from one another can be situated in one foil conductor strip.

The electrical line connection between the antenna layer and the signal line or the ground line and the functional layer is done, for example, via electrically conductive adhesive or or via a solder connection, both of which enable a secure and permanent electrical line connection. Alternatively, the electrical line connection can be done by clamping, wherein the clamping is, for example, produced by connecting one end of the signal line of the strip conductor to the antenna layer via a press contact and by connecting one end of the ground line of the same or another strip conductor to the functional layer.

In accordance with one embodiment of the antenna pane, it has a plurality of antenna structures, as are described above. If all antenna layers are arranged on one and the same surface of the at least one substrate, the antenna layers are in each case surrounded by an insulation zone, in other words, the antenna layers are galvanically separated from one another, wherein a high-frequency technical resistance between the individual antenna layers is at least 10 ohm, preferably at least 50 ohm. The antenna layers are thus strongly decoupled in terms of high-frequency technology and can act as individual patch antennas. The antenna layers are, in each case, preferably at least partially, in particular completely, arranged in a separate cutout of the functional layer and have, in each case, an insulating line. However, two or more antenna layers, in particular all antenna layers, can also be arranged at least partially, in particular completely, in a common cutout. The antenna layers can also be arranged on different surfaces of one substrate or of a plurality of substrates. Here, the antenna layers are, when viewed perpendicularly through the substrate, in each case arranged at least partially within one and the same cutout or pass-through region or multiple pass-through regions. Multiple patch antennas can advantageously be used for the application of MIMO technology.

Advantageously, the antenna layer of the or of each antenna structure is implemented at the wry edge of the antenna pane. In this case, the maximum distance from the outer edge of the antenna pane is preferably less than 20 cm, particularly preferably less than 10 cm. This allows the antenna layer and its supply lines to be concealed under a visually inconspicuous black print or to be concealed by a cover.

The invention further extends to an antenna pane assembly that has an antenna pane as described above, as well as receiving or transmitting electronics that are electrically connected by a signal line to the first connection region and by a ground line to the second connection region of the at least one antenna structure. Preferably, the signal line and the ground line are in each case implemented in the form of a flat conductor, thus enabling, in particular, simple and reliable contacting of the antenna layer and the functional layer in a composite pane.

The invention further extends to a method for producing an antenna pane according to the invention. The method includes a step in which at least one substrate is provided. The method includes a further step in which an electrically conductive functional layer is applied to a surface of the substrate. The method includes a further step in which an antenna structure is formed. This comprises an electrically conductive antenna layer for receiving and/or transmitting high-frequency antenna signals, wherein the antenna layer is galvanically separated from the functional layer, wherein a high-frequency technical resistance between the antenna layer and the functional layer for high-frequency antenna signals is at least 10 ohm, wherein the antenna layer has a first connection region and the functional layer has a second connection region. The antenna structure further includes an insulating line, by means of which the functional layer is electrically divided into a first functional layer zone and a second functional layer zone, wherein the two functional layer zones are galvanically separated from one another, but are coupled using high-frequency technology such that a high-frequency technical resistance for high-frequency antenna signals is less than 1 ohm, wherein the second connection region is contained in the second functional layer zone.

The application of the functional layer can be done by methods known per se, preferably by magnetron-enhanced cathodic sputtering. This is particularly advantageous in terms of simple, rapid, economical, and uniform coating of the substrate. However, the functional layer can also be applied, for example, by vapor deposition, chemical vapor deposition (CVD), plasma-enhanced chemical vapor deposition (PECVD), or by wet chemical methods.

Preferably, the insulation zone described in connection with the antenna pane and the cutout ae produced by partial or complete decoating of the functional layer. Advantageously, the antenna layer is produced from the functional layer. The decoating is done, for example, by a laser beam. The decoating of a line with a width that is wider than the width of one laser beam cone can be done by repeatedly tracing the line with the laser beam. Alternatively, the decoating can be done by mechanical ablation as well as by chemical or physical etching.

To produce a composite pane, at least two panes (substrates) are joined together (laminated) via at least one thermoplastic adhesive layer, preferably under the action of heat, vacuum, and/or pressure. Methods known per se can be used to produce a composite pane. For example, so-called "autoclave processes" can be carried out at an elevated pressure of approx. 10 bar to 15 bar and temperatures of 130° C. to 145° C. for approx. 2 hours. Vacuum bag or vacuum ring processes known per se operate, for example, at approx. 200 mbar and 130° C. to 145° C. The panes and the thermoplastic intermediate layer can also be pressed in a calender between at least one roller pair to form a composite pane. Systems of this type are known for producing composite panes and normally have at least one heating tunnel upstream from a pressing unit. The temperature during the pressing operation is, for example, from 40° C. to 150° C. Combinations of calendering and autoclaving processes have proved particularly effective in practice. Alternatively, vacuum laminators can be used. These consist of one or a plurality of heatable and evacuable vacuum chambers, in which the first pane and the second pane can be laminated within, for example, about 60 minutes at reduced pressures of 0.01 mbar to 800 mbar and temperatures of 80° C. to 170° C.

Flat conductors for contacting the antenna layer and the functional layer can be laminated between the substrates in a simple manner, with the flat conductors routed out of the composite between the panes.

In principle, the antenna pane can be provided for any uses, for example, as glazing in buildings, in particular in the access area, window area, roof area, or façade area, as a built-in part in furniture and appliances, in means of transportation for travel on land, in the air, or on water, in particular in trains, watercraft, and motor vehicles, for example, as a windshield, rear window, side window, and/or roof panel.

Preferred according to the invention is the use of the antenna pane in means of transportation for travel on land, in the air, or on water, in particular in motor vehicles for example, as a windshield, a rear window, side windows, and/or a roof panel.

Use of an antenna pane according to the invention as a windshield is particularly advantageous. Thus, for example, mobile phone transmission stations are installed along highways or expressways. The high-frequency, electromagnetic radiation can then enter the interior of the vehicle from the front through the windshield in the direction of travel. In cities, mobile phone transmission stations are usually installed on roofs or in elevated positions and beam down from above. Satellite signals similarly beam down from above onto a vehicle. Since windshields have a highly inclined installation position in order to improve aerodynamics, mobile phone signals or satellite signals also enter the vehicle interior from above through the pane.

Further features of the invention emerge from the following description:

The invention relates to an antenna pane, comprising:

at least one electrically insulating substrate, at least one electrically conductive functional layer on a surface of the substrate, at least one electrically conductive antenna layer for receiving transmitting high-frequency antenna signals, wherein the at least one antenna layer is galvanically separated from the functional layer, wherein a high-frequency technical resistance between the antenna layer and the functional layer for antenna signals received by the antenna layer is at least ohm, and wherein the antenna layer is electrically conductively coupled to a signal line for coupling out antenna signals received by the antenna layer and the functional layer is electrically conductively coupled to a ground line to provide a reference potential for the antenna signals.

In accordance with one embodiment of the antenna pane, the at least one antenna layer and the functional layer are arranged on the same surface of the at least one substrate, wherein the at least one antenna layer is galvanically separated by an electrically insulating insulation zone. In accordance with another embodiment, a shortest distance of the antenna layer from the functional layer is at least 0.5 mm and is, in particular, in the range from 0.5 mm to 5 mm. In accordance with another embodiment, the at least one antenna layer and the functional layer are arranged on different surfaces of the at least one substrate, in particular, on different surfaces of a plurality of substrates, wherein the antenna layer is arranged closer to the interior than the functional layer, and wherein the at least one antenna layer is situated, when viewed perpendicularly through the substrate, at least partially within a pass-through region formed in the functional layer, in which the functional layer is partially or completely absent such that the pass-through region is transparent to high-frequency electromagnetic radiation. In accordance with another embodiment, the antenna layer is made of the same material as the functional layer. In accordance with another embodiment, the antenna layer is made of a material different from the functional layer. In accordance with another embodiment, the at least one antenna layer is arranged within a cutout, in particular a cutout at the very edge, of the functional layer. In accordance with another embodiment, the functional layer has an insulating line surrounding the at least one antenna layer, by means of which the functional layer is divided into two functional layer zones adjacent the insulating line, which are galvanically separated from one another, but coupled using high-frequency technology such that a high-frequency technical resistance for antenna signals received by the antenna layer is less than 1 ohm. In accordance with another embodiment, the insulating line has a width of less than 150 μm. In accordance with another embodiment, the antenna pane has a plurality of antenna layers. In accordance with another embodiment, the antenna pane has at least two substrates that are fixedly bonded to one another by a thermoplastic intermediate layer, wherein the functional layer is applied to an inner surface of at least one of the two substrates. In accordance with another embodiment, the signal line and the ground line are implemented in each case in the form of a flat conductor.

The invention further relates to an antenna pane assembly that includes an antenna pane, as described immediately above. The antenna pane assembly further includes reception or transmission electronics that are electrically coupled to the at least one antenna layer and the functional layer by means of the signal line and which is electrically connected to the ground line electrically coupled to the functional layer.

The invention further relates to a method for producing an antenna pane described immediately above, which includes: applying an electrically conductive functional layer to a surface of a substrate; forming at least one electrically conductive antenna layer for receiving/transmitting high-frequency antenna signals such that the at least one antenna layer is galvanically separated from the functional layer, wherein a high-frequency technical resistance between the antenna layer and the functional layer for antenna signals received by the antenna layer is at least 10 ohm; electrically conductive coupling of the antenna layer to a signal line for decoupling out antenna signals received by the antenna layer, and electrically conductive coupling of the functional layer to a ground line that provides a reference potential for the antenna signals.

The various embodiments of the invention can be realized individually or in any combinations. In particular, the features mentioned above and to be explained in the following can be used not only in the combinations indicated, but also in other combinations or in isolation, without departing from the scope of the present invention.

Figure 2:
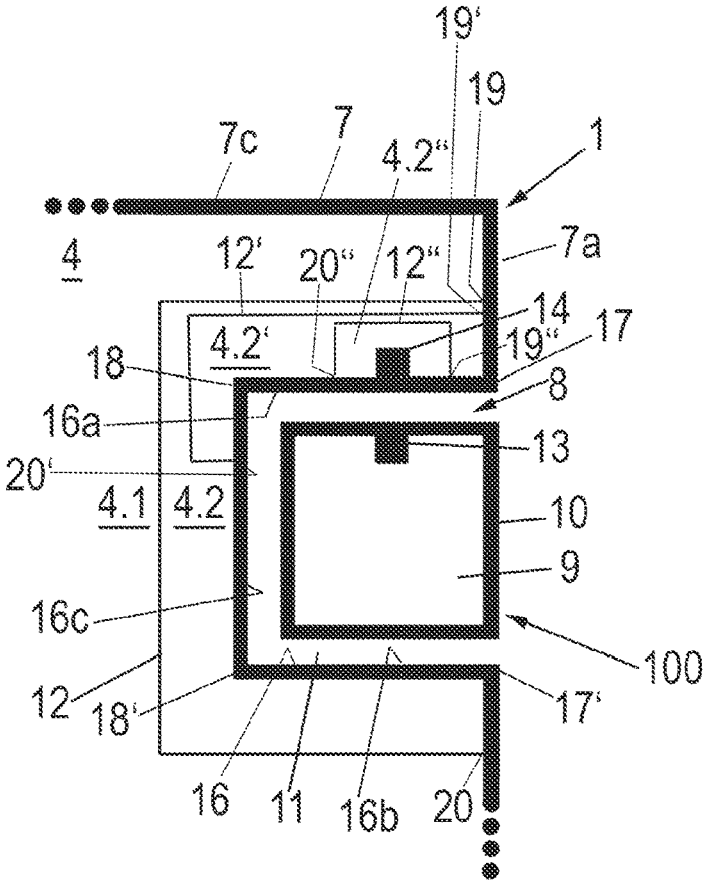
Figure 3:
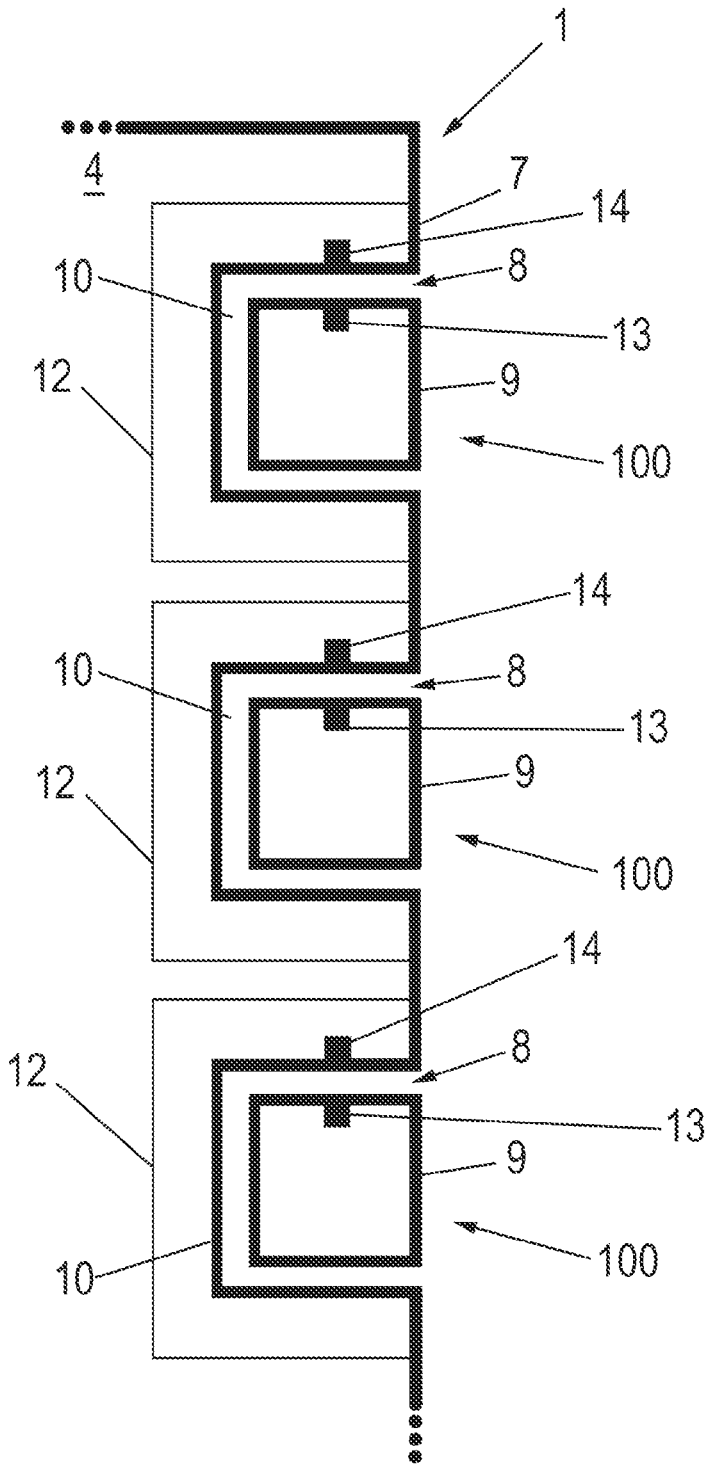
Figure 4:
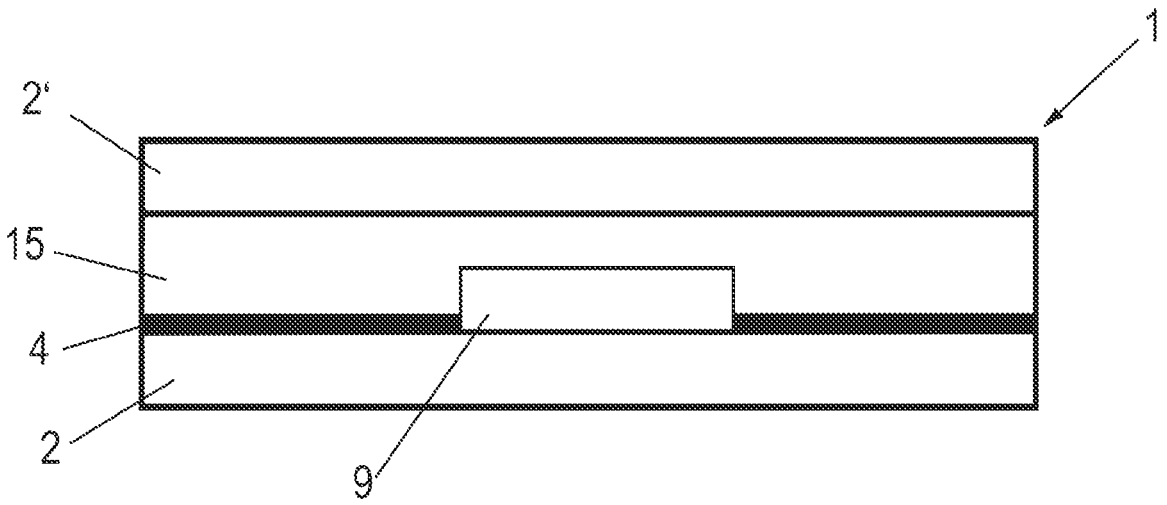
Figure 5:
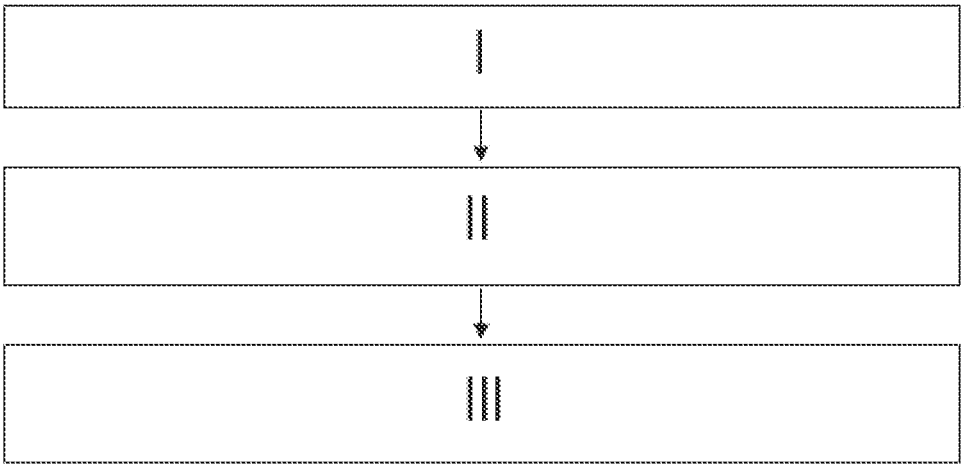

The invention is explained in more detail in the following using exemplary embodiments, with reference being made to the accompanying figures. In simplified, not-to-scale representation, they depict:

FIG. 1 a plan view of an embodiment of the antenna pane according to the invention, FIG. 2 a plan view of an enlarged detail of the antenna pane of FIG. 1, wherein a corner section of the antenna pane is depicted, FIG. 3 a plan view of another embodiment of the antenna pane according to the invention, wherein only a corner section of the antenna pane is depicted, FIG. 4 a cross-sectional representation of an embodiment of the antenna pane according to the invention, implemented in the form of a composite pane, FIG. 5 a flow chart to illustrate the method according to the invention.

First, FIGS. 1 and 2 are considered. FIG. 1 depicts a plan view of an exemplary embodiment of the antenna pane 1 according to the invention in a highly simplified, schematic representation. FIG. 2 depicts an enlarged detail of the antenna pane 1 of FIG. 1 in the upper right corner region.

Here, the antenna pane 1 comprises, for example, a glass substrate 2 (not shown in detail in FIG. 2), on the surface 3 of which a transparent, electrically conductive coating in the form of a functional layer 4 is applied. The antenna pane 1 can comprise only a single substrate 2. However, it is also possible for the substrate 2 to be laminated with another substrate to forma composite pane, wherein the functional layer 4 is arranged on the inside of the composite pane (see FIG. 4). The antenna pane 1 can, for example, be installed in a building or in a motor vehicle to separate an interior space from an external environment. The functional layer 4 serves here, for example, as a thermal protection layer to reduce heat input into the interior. The glass substrate 2 is made here, for example, of soda lime glass and is depicted in the shape of a rectangle in this simplified representation. It goes without saying that the antenna pane 1 can have any other suitable geometric shape and/or curvature. As a windshield, the antenna pane 1 typically has a convex curvature.

As is discernible in FIG. 1, the antenna pane 1 has a layer-free edge decoating region 5. The edge decoating region 5 extends from one pane edge 6 of the antenna pane 1 all the way to a set-back functional layer edge 7 of the functional layer 4. Here, the edge decoating region 5 has a constant width such that the functional layer 4 has the same shape as the substrate 2 (here, for example, rectangular). The shape of functional layer 4 can however be different from the shape of the substrate 2.

Here, the antenna pane 1 includes, for example, a rectangular layer-free cutout 8 of the functional layer 4, in which an antenna layer 9 is situated. The cutout 8 is arranged at the very edge and implemented as a depression of the functional layer edge 7. The shape of the cutout 8 is only exemplary, with the understanding that the cutout 8 can also have any other shape, for example, circular. The expression "layer-free" means that, in the cutout 8, the functional layer 4 is removed or not formed (in the context of the invention, if the antenna layer 9 situated in the cutout is formed from the material of the functional layer 4, it is not considered to be part of the functional layer 4).

As depicted in FIG. 1, the functional layer edge 7 can be divided into four respective rectilinear functional layer edge sections 7*a*, 7*b*, 7*c*, 7*d*. Corresponding to the exemplary rectangular shape of the functional layer 4, the functional layer edge 7 comprises the two parallel functional layer edge sections 7*a*, 7*b* and the two parallel functional layer edge sections 7*d* [sic: 7*c*], 7*d*. If the antenna pane 1 is intended to be the windshield of a motor vehicle, the outer shape can, for example, resemble a trapezoid. In this case, for example, the two functional layer edge sections 7*d* [sic: 7*c*], 7*d* could be positioned at an angle relative to one another rather than parallel. In the figure, the cutout 8 is illustrated as a depression of the functional layer edge section 7*a*, with it being equally possible for the cutout 8 to be implemented on one of the other functional layer edge sections 7*b*, 7*c*, 7*d*.

The cutout 8, which is, for example, rectangular here, is delimited by a cutout edge 16, which is a part or region of the functional layer edge 7, here, for example, of the functional layer edge section 7*a*. The cutout edge 16 is a recessed part of the functional layer edge section 7*a* such that the functional layer edge section 7*a* can be divided into a recess region (i.e., the cutout edge 16) and a non-recessed region. The cutout edge 16 is formed by the functional layer 4.

The cutout edge 16 can, according to the shape of the cutout 8, be divided into three rectilinear cutout edge sections 16*a*, 16*b*, 16*c*. Thus, the cutout edge 16 comprises two parallel cutout edge sections 16*a*, 16*b*, which are connected by a cutout edge section 16*c* perpendicular thereto. Here, the two parallel cutout edge sections 16*a*, 16*b* extend, for example, perpendicular to the functional layer edge section 7*a*; the other cutout edge section 16*c* is arranged parallel to the functional layer edge section 7*a*. Here, a first cutout edge section 16*a* extends from an outer edge section end point 17 of the non-recessed functional layer edge section 7*a* to an inwardly offset, inner edge section end point 18. A second cutout edge section 16*b* extends from an outer edge section end point 17' of the non-recessed functional layer edge section 7*a* to an inwardly offset inner edge section end point 18'. The third cutout edge section 16*c* extends from the one inner edge section end point 18 to the other inner edge section end point 18'.

The electrically conductive antenna layer 9, which serves as a patch antenna, is situated within the cutout 8. Accordingly, the antenna layer 9 is designed layer-shaped or a really expanded. The antenna layer 9 is delimited by a circumferential antenna layer edge 10. Adjacent the pane edge 6, the antenna layer edge 10 ends flush with the functional layer edge 7, in this case, for example, the non-recessed functional layer edge section 7*a* An insulation zone 11 (see also enlarged view FIG. 2) is situated between the antenna layer 9 and the functional layer 4. The insulation zone 11 is the part of the layer-free cutout 8 immediately adjacent the functional layer 4 that has no antenna layer 9. Accordingly, the insulation zone 11 is equally layer-free, with the functional layer 4 removed or not formed.

The antenna layer 9 is galvanically separated from the functional layer 4 by the insulation zone 11. The insulation zone 11 has a minimum width, defined by the shortest distance between the cutout edge 16 and the antenna layer edge 10, which is dimensioned in a size such that there is a high-ohmic resistance (at least 10 ohm) for high-frequency antenna signals received and/or transmitted by the antenna layer 9. For example, the insulation zone 11 has a constant width. Preferably, the antenna layer 9 is designed such that high-frequency electromagnetic radiation in the frequency range from 0.6 to 6 GHz (5G mobile communication standard) can be received. The minimum width of the insulation zone 11 is preferably at least 0.5 mm and is, in particular, in the range from 0.5 mm to 5 mm, as a result of which a high-ohmic resistance of at least 50 ohm can be achieved for the high-frequency antenna signals received and/or transmitted by the antenna layer 9.

Here, the antenna layer 9 is, for example, made of the same material of the functional layer 4, whereby the insulation zone 11 merely has to be decoated to create the cutout 8. Alternatively, the antenna layer 9 can be made from a material different from the functional layer 4 and can, for example, be applied on the substrate 2 in the form of a metal foil or a plastic film coated with a metal or a metal alloy.

As shown schematically in FIG. 2, the antenna layer 9 has a first connection region 13 (signal-line connection region), which is or can be electrically coupled, for example, galvanically or capacitively, to a signal line (not shown). The signal line is, for example, a flat conductor. The functional layer 4 further has a second connection region 14 (ground-line connection region), which is or can be electrically coupled, for example, galvanically or capacitively, to a ground line (not shown). The ground line is, for example, a flat conductor. When the antenna pane 1 is a composite pane, the two flat conductors can be laminated between a in a simple manner and routed out of the pane composite.

The antenna layer 9 is, for example, a broadband monopole antenna of the unipolar type, with the first connection region 13 serving as a first electrode and the second connection region 14 serving as a second electrode. High-frequency antenna signals received by the antenna layer 9 can be coupled out or antenna signals can be coupled in through the first connection region 13, with a reference potential for the antenna signals provided by the second connection region 14. For example, the first connection region 13 can be electrically connected to the inner conductor and the second connection region 14 can be electrically connected to the outer conductor of a coaxial conductor, which is known to the person skilled in the art such that is unnecessary to go into greater detail here. Through the use of the functional layer 4 as a reference potential, the transmitting/receiving performance of the antenna layer 9 can be significantly improved.

As depicted in FIG. 2, the functional layer 4 includes an insulating line, wherein three exemplary alternatives for such an insulating line, labeled with the reference characters 12, 12', 12''' [sic: 12"], are depicted in FIG. 2. In each case, only a single insulating line 12, 12', 12''' [sic: 12"] is provided.

Common to the alternative insulating lines 12, 12', 12" is the fact that they electrically divide the functional layer 4 into a first functional layer zone 4.1 and a second functional layer zone 4.2, 4.2', 4.2" containing the second connection region 14. Thus, the functional layer 4 is electrically divided by the insulating line 12 into a first functional layer zone 4.1 and a second functional layer zone 4.2. The functional layer 4 is electrically divided into a first functional layer zone 4.1 and a second functional layer zone 4.2' by the alternative insulating line 12'. The functional layer 4 is electrically divided into a first functional layer zone 4.1 and a second functional layer zone 4.2" by the alternative insulating line 12". It is essential here that the second functional layer zones 4.2, 4.2', 4.2" contain, in each case, the second connection region 14.

The alternative insulating lines 12, 12', 12" have a different course. The insulating line 12 completely surrounds the cutout 8 or the cutout edge 16. The insulating line 12 begins at a first insulating line end point 19 of the non-recessed functional layer edge 7*a* and ends at a second insulating line end point 20 of the non-recessed functional layer edge 7*a*. The second functional layer zone 4.2 electrically divided thereby from the functional layer 4 surrounds the antenna layer 9 as much as possible, i.e., partially or completely with the exception of the "open" side of the functional layer edge section 7*a*. It would be equally possible for the insulating line 12 to begin and/or end at one of the other functional layer edge sections 7*b*, 7*c*, 7*d*. For example, the insulating line 12 could begin at the functional layer edge section 7*c* and end at the (non-recessed) functional layer edge section 7*a*. Here, for example, the insulating line 12 follows the contour of the cutout edge 16, with a shortest distance between the insulating line 12 and the cutout edge 16 being equal, with it being equally possible for the insulating line 12 not to follow the contour of the cutout edge 16.

The alternative insulating line 12' does not completely surround the cutout 8 or the cutout edge 16. The insulating line 12' begins at a first insulating line end point 19' of the non-recessed functional layer edge 7*a* and ends at a second insulating line end point 20' of the recessed functional layer edge 7*a*, i.e., at the cutout edge 16, here, for example, at the cutout edge section 16*c*. It would be equally possible for the insulating line 12' to begin at one of the other functional layer edge sections 7*b*, 7*c*, 7*d*. For example, the insulating line 12' could begin at the functional layer edge section 7*c* and end at the recessed functional layer edge 7*a*, i.e., at the cutout edge 16. It would also be equally possible for the insulating line 12' to end at one of the other cutout edge sections 16*a*, 16*b*. Here, the insulating line 12' partly follows the contour of the cutout edge 16, with a shortest distance between the insulating line 12 and the cutout edge 16 being equal, with it being equally possible for the insulating line 12 not to follow the contour of the cutout edge 16.

The alternative insulating line 12" does not completely surround the cutout 8 or the cutout edge 16. The insulating line 12" begins at a first insulating line end point 19' of the recessed functional layer edge 7*a*, i.e., at the cutout edge 16, here, for example, at the cutout edge section 16*a*, and ends at a second insulating line end point 20' of the recessed functional layer edge 7*a*, i.e., at the cutout edge 16, here, for example, at the cutout edge section 16*a*. It would be equally possible for the insulating line 12" to end at one of the other cutout edge sections 16*b*, 16*c*.

The respective insulating line 12, 12', 12" divides the functional layer 4 into two directly adjacent functional layer zones 4.1, 4.2, 4.2', 4.2", which are galvanically separated from one another, but coupled low ohmically (less than 1 ohm) with respect to high-frequency antenna signals. For this purpose, the insulating line 12, 12', 12" is implemented correspondingly thin (line width preferably less than 150 μm). The insulating line 12, 12', 12" prevents an electrical current flowing in the functional layer 4, which is introduced into the functional layer 4, for example, through bus bars, to control the functional layer 4, from being able to flow into the functional layer zone 4.2, 4.2', 4.2" containing the second connection region 14. As a result, an undesired malfunction of the antenna structure 100 can be avoided and the antenna function can be further improved.

The assembly comprising the antenna layer 9, the insulation zone 11, the first connection region 13, and the second connection region 14 constitutes an antenna structure 100 for receiving/transmitting high-frequency antenna signals.

It would also be conceivable for the cutout 8 to be arranged completely within the functional layer 4, i.e., fully surrounded by the functional layer 4. This is illustrated in FIG. 1.

FIG. 1 depicts an antenna structure 100' alternative to the antenna structure 100, in which the cutout 8' is arranged completely within the functional layer 4. The antenna layer 10', which is electrically insulated from the surrounding functional layer 4 by the insulation zone 11', is situated within the cutout 8'. The antenna layer 9' has a first connection region 13' (signal-line connection region); the functional layer 4 has a second connection region 14' (ground-line connection region). The cutout 8' is delimited by the cutout edge 16'.

The insulating line 12" divides the functional layer 4 into a first functional layer zone 4.1 and a second functional layer zone 4.2" containing the second connection region 14'. The insulating line 12" does not completely surround the cutout 8' or the cutout edge 16'.

The insulating line 12" begins at a first insulating line end point 19' at the cutout edge 16' ends at the second insulating line end point 20' of the cutout edge 16'.

Now, FIG. 3 is considered, wherein another embodiment of the antenna pane 1 is illustrated. In order to avoid unnecessary repetition, only the differences from the embodiment of FIGS. 1 and 2 are discussed. FIG. 3 depicts an enlarged detail of the antenna pane 1 in the corner region analogous to FIG. 2. Accordingly, the antenna pane 1 includes a plurality of antenna structures 100, as depicted in FIG. 2. The functional layer 4 has, for this purpose, a plurality of cutouts 8, in which, in each case, antenna layers 9 are arranged. The antenna layers 9 are, in each case, galvanically separated from the functional layer 4 by an insulation zone 11. The antenna layer 9 of each antenna structure 100 has a first connection region 13 and a second connection region 14. The functional layer 4 provides a common reference potential for all antenna layers 9. Each antenna structure 100 includes a separate insulating line 12, 12', 12", with only the alternative in accordance with reference number "12" shown in FIG. 3.

FIG. 4 depicts a cross-sectional representation through another embodiment of the antenna pane 1. Only the features discernible here are described and, otherwise, reference is made to the statements above. In this embodiment, the antenna pane is a composite pane, in which a first substrate 2 (e.g., inner pane) and a second substrate 2' (e.g., outer pane) are fixedly bonded to one another by a thermoplastic intermediate layer 15. The two substrates 2, 2' are made, in each case, of glass, preferably thermally toughened soda lime glass, and are transparent to visible light. The thermoplastic intermediate layer 15 is made of a thermoplastic plastic, preferably polyvinyl butyral (PVB), ethylene vinyl acetate (EVA), and/or polyethylene terephthalate (PET). The outer surface of the second substrate 2' faces the external environment and is, at the same time, the outer surface of the antenna pane 1. The inner surface of the second substrate 2' as well as the inner surface of the first substrate 2 face the intermediate layer 15 in each case. The outer surface of the first substrate 2 faces an interior space, e.g., a vehicle interior, and is, at the same time, the inner surface of the antenna pane 1.

The functional layer 4, which is provided with a cutout 8 in which the functional layer 4 is removed or is not formed, is situated on the first substrate 2. An antenna layer 9, implemented here, for example, as a metal foil (sketched thickened for illustration purposes) is arranged within the cutout 8. The metal foil is, for example, adhesively bonded to the substrate 2. The antenna layer 9 is protected against external influences by the thermoplastic intermediate layer 15. It goes without saying that an insulation zone 11, not shown in FIG. 4, is situated between the antenna layer 9 and the functional zone 4.

FIG. 5 illustrates the method according to the invention, using a flow chart. Here, in a first step I, at least one substrate (2, 2') is provided. Ina second step II, an electrically conductive functional layer (4) is applied to a surface (3) of the substrate (2, 2'). The method includes a third step III, in which at least one antenna structure (100, 100') is formed, which comprises:

an electrically conductive antenna layer (9, 9') for receiving and/or transmitting high-frequency antenna signals, wherein the antenna layer (9, 9') is galvanically separated from the functional layer (4), wherein a high-frequency technical resistance between the antenna layer (9, 9') and the functional layer (4) for high-frequency antenna signals is at least 10 ohm, wherein the antenna layer (9, 9') has a first connection region (13, 13') and the functional layer (4) has a second connection region (14, 14'), an insulating line (12 12', 12"), by means of which the functional layer (4) is electrically divided into a first functional layer zone (4.1) and a second functional layer zone (4.2, 4.2', 4.2"), wherein the two functional layer zones (4.1, 4.2, 4.2', 4.2") are galvanically separated from one another, but coupled using high-frequency technology such that a high-frequency technical resistance for high-frequency antenna signals is less than 1 ohm, wherein the second connection region (14, 14') is contained in the second functional layer zone (4.2, 4.2', 4.2").

From the above statements, it follows that the invention makes available an improved antenna pane with one or a plurality of integrated antenna structures. The functional layer of the antenna pane serves to provide an electrical reference potential for one or a plurality of antenna layers. High-frequency antenna signals can be received/transmitted with a good signal strength. A plurality of antenna structures can be implemented in a simple manner. The antenna pane is particularly well-suited for the new 5G mobile communication standard.

LIST OF REFERENCE CHARACTERS

1 antenna pane
2, 2' substrate
3 surface
4 functional layer
4.1 first functional layer zone
4.2, 4.2', 4.2'" second functional layer zone
5 edge decoating region
6 pane edge
7 functional layer edge
7*a*, 7*b*, 7*c*, 7*d* functional layer edge section
8, 8' cutout
9, 9' antenna layer
10, 10' antenna layer edge
11, 11' insulation zone
12, 12', 12" insulating line
13, 13' first connection region
14, 14' second connection region
15 intermediate layer
16, 16' cutout edge
16*a*, 16*b*, 16*c* cutout edge section
17, 17' outer edge section end point
18, 18' inner edge section end point
19, 19', 19" first insulating line end point
20, 20', 20" second insulating line end point
100 antenna structure

The invention claimed is:

1. Antenna pane that comprises at least one electrically insulating substrate, at least one electrically conductive functional layer on a surface of the substrate, and at least one antenna structure, wherein the antenna structure comprises:

an electrically conductive antenna layer for receiving and/or transmitting high-frequency antenna signals, wherein the antenna layer is galvanically separated from the functional layer, wherein a high-frequency technical resistance between the antenna layer and the functional layer for high-frequency antenna signals is at least 10 ohm, wherein the antenna layer has a first connection region and the functional layer has a second connection region, an insulating line, by means of which the functional layer is electrically divided into a first functional layer zone and a second functional layer zone, wherein the first and second functional layer zones are galvanically separated from one another, but are coupled using high-frequency technology such that a high-frequency technical resistance for high-frequency antenna signals is less than 1 ohm, wherein the second connection region is contained in the second functional layer zone.

2. The antenna pane according to claim 1, wherein the insulating line of the at least one antenna structure has a maximum width of less than 150 μm.

3. The antenna pane according to claim 1, wherein the antenna layer of the at least one antenna structure is arranged, at least when viewed perpendicularly through the at least one substrate, at least partially, within a cutout of the functional layer.

4. The antenna pane according to claim 3, wherein the insulating line completely surrounds a cutout edge delimiting the cutout.

5. The antenna pane according to claim 4, wherein the insulating line, which extends from a first insulating line end point to a second insulating line end point, is designed such that at least one of the first and second insulating line end points lies on a functional layer edge of the functional layer that does not form part of the cutout.

6. The antenna pane according to claim 5, wherein both the first and second insulating line end points lie on a functional layer edge of the functional layer that does not form part of the cutout.

7. The antenna pane according to claim 3, wherein the insulating line does not completely surround a cutout edge delimiting the cutout.

8. The antenna pane according to claim 7, wherein the insulating line, which extends from a first insulating line end point to a second insulating line end point, is designed such that at least one of the first and second insulating line end points lies on the cutout edge.

9. The antenna pane according to claim 8, wherein both the first and second insulating line end points lie on the cutout edge.

10. The antenna pane according to claim 3, wherein the antenna layer and the functional layer of the at least one antenna structure are arranged on a same surface of the at least one substrate, wherein the antenna layer and the functional layer are galvanically separated from one another by an electrically insulating insulation zone.

11. The antenna pane according to claim 10, wherein the insulation zone has a minimum width of at least 0.5 mm.

12. The antenna pane according to claim 11, wherein the insulation zone has a minimum width in the range from 0.5 mm to 5 mm.

13. The antenna pane according to claim 3, wherein the at least one antenna layer and the functional layer of the at least one antenna structure are arranged on different surfaces of the at least one substrate, wherein the antenna layer is arranged closer to the interior than the functional layer, and wherein the at least one antenna layer is situated, when viewed perpendicularly through the substrate, at least partially within a cutout formed in the functional layer, in which the functional layer is partially or completely absent such that the cutout is transparent to high-frequency electromagnetic radiation.

14. The antenna pane according to claim 13, wherein the at least one antenna layer and the functional layer of the at least one antenna structure are arranged on different surfaces of a plurality of substrates.

15. The antenna pane according to claim 3, wherein the antenna layer of the at least one antenna structure is arranged, at least when viewed perpendicularly through the at least one substrate, completely within a cutout of the functional layer.

16. The antenna pane according to claim 1, wherein the antenna layer of the at least one antenna structure is made of the same material as the functional layer.

17. The antenna pane according to claim 1, wherein the antenna layer of the at least one antenna structure is made of a material different from the functional layer.

18. Antenna pane assembly, which comprises:

an antenna pane according to claim 1, receiving and/or transmitting electronics, which are electrically connected by a signal line to the first connection region and by a ground line to the second connection region of the at least one antenna structure.

19. Method for producing an antenna pane according to claim 1, comprising:

providing at least one substrate, applying an electrically conductive functional layer to a surface of the substrate, forming at least one antenna structure, which comprises:

an electrically conductive antenna layer for receiving and/or transmitting high-frequency antenna signals, wherein the antenna layer is galvanically separated from the functional layer, wherein a high-frequency technical resistance between the antenna layer and the functional layer for high-frequency antenna signals is at least 10 ohm, wherein the antenna layer has a first connection region and the functional layer has a second connection region, an insulating line, by means of which the functional layer is electrically divided into a first functional layer zone and a second functional layer zone, wherein the first and second functional layer zones are galvanically separated from one another, but are coupled using high-frequency technology such that a high-frequency technical resistance for high-frequency antenna signals is less than 1 ohm, wherein the second connection region is contained in the second functional layer zone.

20. A method comprising installing the antenna pane according to claim 1 in a transportation vehicle for travel on land, in the air, or on water.

21. The antenna pane according to claim 1, wherein the antenna layer of the at least one antenna structure is arranged, at least when viewed perpendicularly through the at least one substrate, at least partially, within a cutout of the functional layer, and wherein, at least when viewed perpendicularly through the at least one substrate, a spatial distance between the antenna layer and the cutout along an entire edge of the cutout is from 0.5 mm to 5 mm.

* * * * *